US010612775B2

(12) United States Patent
Johnson et al.

(10) Patent No.: US 10,612,775 B2
(45) Date of Patent: Apr. 7, 2020

(54) DUAL-FUEL FUEL NOZZLE WITH AIR SHIELD

(71) Applicant: General Electric Company, Schenectady, NY (US)

(72) Inventors: Thomas Edward Johnson, Greer, SC (US); Kaitlin Marie Graham, Greenville, SC (US); Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 270 days.

(21) Appl. No.: 15/626,486

(22) Filed: Jun. 19, 2017

(65) Prior Publication Data

US 2018/0363899 A1 Dec. 20, 2018

(51) Int. Cl.

| | |
|---|---|
| ***F23D 14/60*** | (2006.01) |
| ***F23R 3/28*** | (2006.01) |
| ***F23R 3/34*** | (2006.01) |
| ***F23R 3/36*** | (2006.01) |
| ***F23D 17/00*** | (2006.01) |
| ***F23R 3/14*** | (2006.01) |

(52) U.S. Cl.

CPC ..... *F23D 14/60* (2013.01); *F23D 17/002* (2013.01); *F23R 3/14* (2013.01); *F23R 3/283* (2013.01); *F23R 3/286* (2013.01); *F23R 3/343* (2013.01); *F23R 3/36* (2013.01); *F23D 2209/30* (2013.01); *F23D 2900/00008* (2013.01); *F23D 2900/00018* (2013.01); *F23D 2900/14003* (2013.01); *F23R 2900/00001* (2013.01)

(58) Field of Classification Search

None

See application file for complete search history.

(56) References Cited

U.S. PATENT DOCUMENTS

| | | | |
|---|---|---|---|
| 2,786,331 | A | 3/1957 | Williams |
| 4,258,544 | A | 3/1981 | Gebhart et al. |
| 4,815,664 | A | 3/1989 | Tuthill et al. |
| 5,408,830 | A | 4/1995 | Lovett |
| 5,813,847 | A | 9/1998 | Eroglu et al. |
| 6,076,356 | A | 6/2000 | Pelletier |
| 6,178,752 | B1 | 1/2001 | Morford |
| 6,311,473 | B1 | 11/2001 | Benjamin et al. |

(Continued)

FOREIGN PATENT DOCUMENTS

WO WO2017034435 A1 3/2017

*Primary Examiner* — Arun Goyal
*Assistant Examiner* — Colin J Paulauskas
(74) *Attorney, Agent, or Firm* — Dority & Manning, P.A.

(57) ABSTRACT

The present disclosure is directed to a dual-fuel fuel nozzle including a center body having a tube shape and a gas fuel plenum defined within the center body. The fuel nozzle also includes a plurality of turning vanes extending radially outward from the center body. Each turning vane includes at least one fuel port in fluid communication with the gas fuel plenum. A plurality of apertures is disposed through the plurality of turning vanes. The fuel nozzle further includes a ring manifold disposed within the center body downstream of the plurality of turning vanes. Additionally, the fuel nozzle includes a first fuel tube extending helically around a centerline of the center body. Furthermore, the fuel nozzle includes an air shield disposed within the center body and extending circumferentially around the first fuel tube.

19 Claims, 8 Drawing Sheets

(56) References Cited

U.S. PATENT DOCUMENTS

| | | | | |
|---|---|---|---|---|
| 6,523,350 | B1 | 2/2003 | Mancini et al. | |
| 6,655,145 | B2 | 12/2003 | Boardman | |
| 7,703,287 | B2 | 4/2010 | Haggerty et al. | |
| 8,281,595 | B2 | 10/2012 | Davis, Jr. et al. | |
| 8,418,469 | B2 | 4/2013 | Myers et al. | |
| 9,010,119 | B2 | 4/2015 | Myers | |
| 9,217,570 | B2 | 12/2015 | Parsania et al. | |
| 9,546,600 | B2 | 1/2017 | Cihlar et al. | |
| 2006/0191268 | A1* | 8/2006 | Widener | F23D 14/78 60/772 |
| 2009/0111063 | A1 | 4/2009 | Boardman et al. | |
| 2009/0218421 | A1 | 9/2009 | Kumaravelu | |
| 2009/0293482 | A1* | 12/2009 | Davis, Jr. | F23D 14/82 60/737 |
| 2010/0205970 | A1 | 8/2010 | Hessler et al. | |
| 2010/0307161 | A1* | 12/2010 | Thomson | F23D 11/107 60/748 |
| 2012/0073302 | A1* | 3/2012 | Myers | F23D 11/402 60/748 |
| 2013/0125548 | A1* | 5/2013 | Dutta | F23R 3/40 60/723 |
| 2014/0116054 | A1* | 5/2014 | Means | F23R 3/283 60/739 |
| 2015/0159875 | A1* | 6/2015 | Berry | F23R 3/286 60/737 |
| 2016/0169110 | A1 | 6/2016 | Myers et al. | |
| 2016/0258628 | A1 | 9/2016 | Ginessin et al. | |

* cited by examiner

DUAL-FUEL FUEL NOZZLE WITH AIR SHIELD

TECHNICAL FIELD

The subject matter disclosed herein relates to a fuel nozzle for a combustion system. More particularly, the disclosure is directed to a dual-fuel fuel nozzle including an air shield.

BACKGROUND

Gas turbines generally operate by combusting a fuel and air mixture in one or more combustors to create a high-energy combustion gas that passes through a turbine, thereby causing a turbine rotor shaft to rotate. The rotational energy of the rotor shaft may be converted to electrical energy via a generator coupled to the rotor shaft. Each combustor generally includes fuel nozzles that provide for delivery of the fuel and air upstream of a combustion chamber, using premixing of the fuel and air as a means to keep nitrogen oxide (NOx) emissions low.

Gaseous fuels, such as natural gas, often are employed as a combustible fluid in gas turbine engines used to generate electricity. In some instances, it may be desirable for the combustion system to be able to combust liquid fuels, such as distillate oil, either simultaneously with or instead of gaseous fuel. A configuration with both gas and liquid fuel capability is called a "dual-fuel" combustion system.

Cooling techniques that prevent thermal breakdown of the liquid fuel and the formation of coke in/on dual-fuel fuel nozzles that supply liquid fuel to the combustion chamber must be considered when designing these types of fuel nozzles. If coke (i.e., carbon formation) is allowed to form, it can cause blockages within the fuel system. Typically, the liquid fuel injector is surrounded by air at elevated temperatures, which are significantly above the temperatures at which coke may be expected to form. To maintain acceptable wetted wall temperatures within the fuel delivery tubes, the liquid fuel itself is often used as a heat sink. However, if the fuel is not moving at a sufficient flow rate, the coke formation temperature may be reached. Likewise, if the air flow surrounding or contacting the liquid fuel delivery tubes is moving too quickly and transferring too much heat to the liquid fuel delivery tubes, the coke formation temperature may be reached.

BRIEF DESCRIPTION

Aspects and advantages are set forth below in the following description, or may be obvious from the description, or may be learned through practice.

In one embodiment, the present disclosure is directed to a dual-fuel fuel nozzle. The dual-fuel fuel nozzle includes a center body having a tube shape and a gas fuel plenum defined within the center body. The dual-fuel fuel nozzle also includes a plurality of turning vanes extending radially outward from the center body. Each turning vane includes at least one fuel port in fluid communication with the gas fuel plenum. A plurality of apertures is disposed through the plurality of turning vanes. The dual-fuel fuel nozzle further includes a ring manifold disposed within the center body downstream of the plurality of turning vanes. Additionally, the dual-fuel fuel nozzle includes a first fuel tube extending helically around a centerline of the center body. Furthermore, the dual-fuel fuel nozzle includes an air shield disposed within the center body and extending circumferentially around the first fuel tube. The air shield is in fluid communication with the plurality of apertures defined through the plurality of turning vanes.

In another embodiment, the present disclosure is directed to a combustor including an end cover. The combustor also includes a plurality of dual-fuel fuel nozzles connected to the end cover and annularly arranged around a centerline of the end cover. Each dual-fuel fuel nozzle includes a center body having a tube shape and a gas fuel plenum defined within the center body. The dual-fuel fuel nozzle also includes a plurality of turning vanes extending radially outward from the center body. Each turning vane includes at least one fuel port in fluid communication with the gas fuel plenum. A plurality of apertures is disposed through the plurality of turning vanes. The dual-fuel fuel nozzle further includes a ring manifold disposed within the center body downstream of the plurality of turning vanes. Additionally, the dual-fuel fuel nozzle includes a first fuel tube extending helically around a centerline of the center body. Furthermore, the dual-fuel fuel nozzle includes an air shield disposed within the center body and extending circumferentially around the first fuel tube. The air shield is in fluid communication with the plurality of apertures defined through the plurality of turning vanes.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode of practicing the various embodiments, is set forth more particularly in the remainder of the specification, including reference to the accompanying figures, in which.

DETAILED DESCRIPTION

Figure 1:
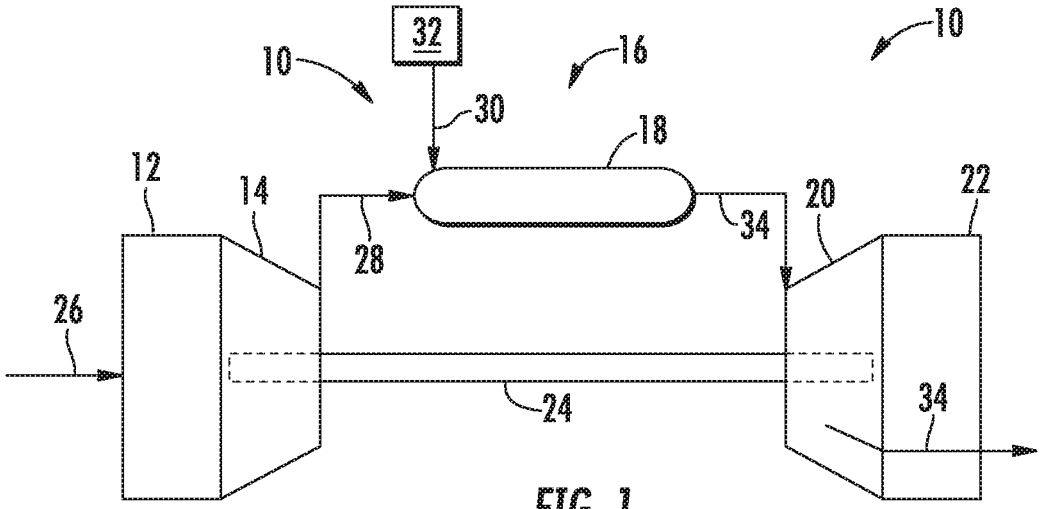
FIG. 1 is a functional block diagram of an exemplary gas turbine as may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a fuel nozzle for a land-based power-generating gas turbine combustor for purposes of illustration, one of ordinary skill in the art will readily appreciate that embodiments of the present disclosure may be applied to any style or type of combustor for a turbomachine and are not limited to combustors or combustion systems for land-based power-generating gas turbines, unless specifically recited in the claims.

Referring now to the drawings, FIG. 1 provides a schematic diagram of an exemplary gas turbine 10. The gas turbine 10 generally includes an inlet section 12, a compressor 14 disposed downstream of the inlet section 12, a combustion system 16 including at least one combustor 18 disposed downstream of the compressor 14, a turbine 20 disposed downstream of the combustor 18 and an exhaust section 22 disposed downstream of the turbine 20. Additionally, the gas turbine 10 may include one or more shafts 24 that couple the compressor 14 to the turbine 20.

During operation, air 26 flows through the inlet section 12 and into the compressor 14 where the air 26 is progressively compressed, thus providing compressed air 28 to the combustor 18. A fuel 30 from a fuel supply 32 is injected into the combustor 18, mixed with a portion of the compressed air 28 and burned to produce combustion gases 34. The combustion gases 34 flow from the combustor 18 into the turbine 20, wherein energy (kinetic and/or thermal) is transferred from the combustion gases 34 to rotor blades (not shown), thus causing shaft 24 to rotate. The mechanical rotational energy may then be used for various purposes such as to power the compressor 14 and/or to generate electricity. The combustion gases 34 exiting the turbine 20 may then be exhausted from the gas turbine 10 via the exhaust section 22.

Figure 2:
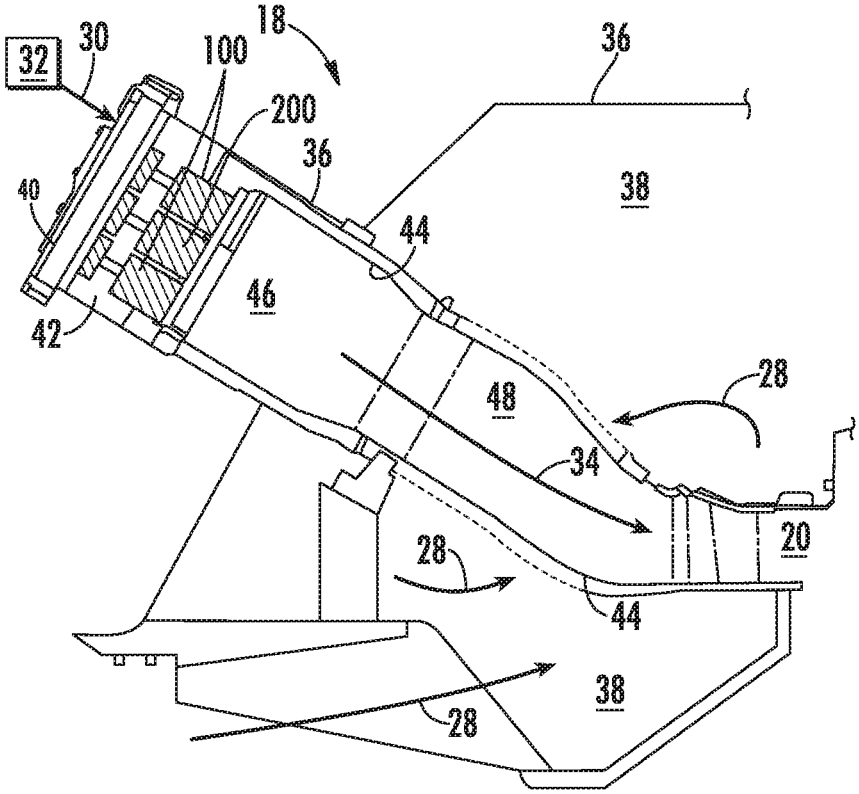
FIG. 2 is a simplified cross-section side view of an exemplary combustor as may incorporate various embodiments of the present disclosure.

FIG. 2 provides a cross-sectioned schematic of an exemplary combustor 18 as may incorporate various embodiments of the present disclosure. As shown in FIG. 2, the combustor 18 may be at least partially surrounded by an outer casing 36, such as a compressor discharge casing. The outer casing 36 may at least partially define a high pressure plenum 38 that at least partially surrounds various components of the combustor 18. The high pressure plenum 38 may be in fluid communication with the compressor 14 (FIG. 1) to receive at least a portion of the compressed air 28 therefrom.

An end cover 40 may be coupled to the outer casing 36. In particular embodiments, the outer casing 36 and the end cover 40 may at least partially define a head end volume or chamber 42 of the combustor 18. In particular embodiments, the head end volume 42 is in fluid communication with the high pressure plenum 38 and/or the compressor 14. One or more liners or ducts 44 may at least partially define a combustion chamber or zone 46 for combusting the fuel-air mixture and/or may at least partially define a hot gas path 48 through the combustor for directing the combustion gases 34 towards an inlet to the turbine 20.

Figure 3:
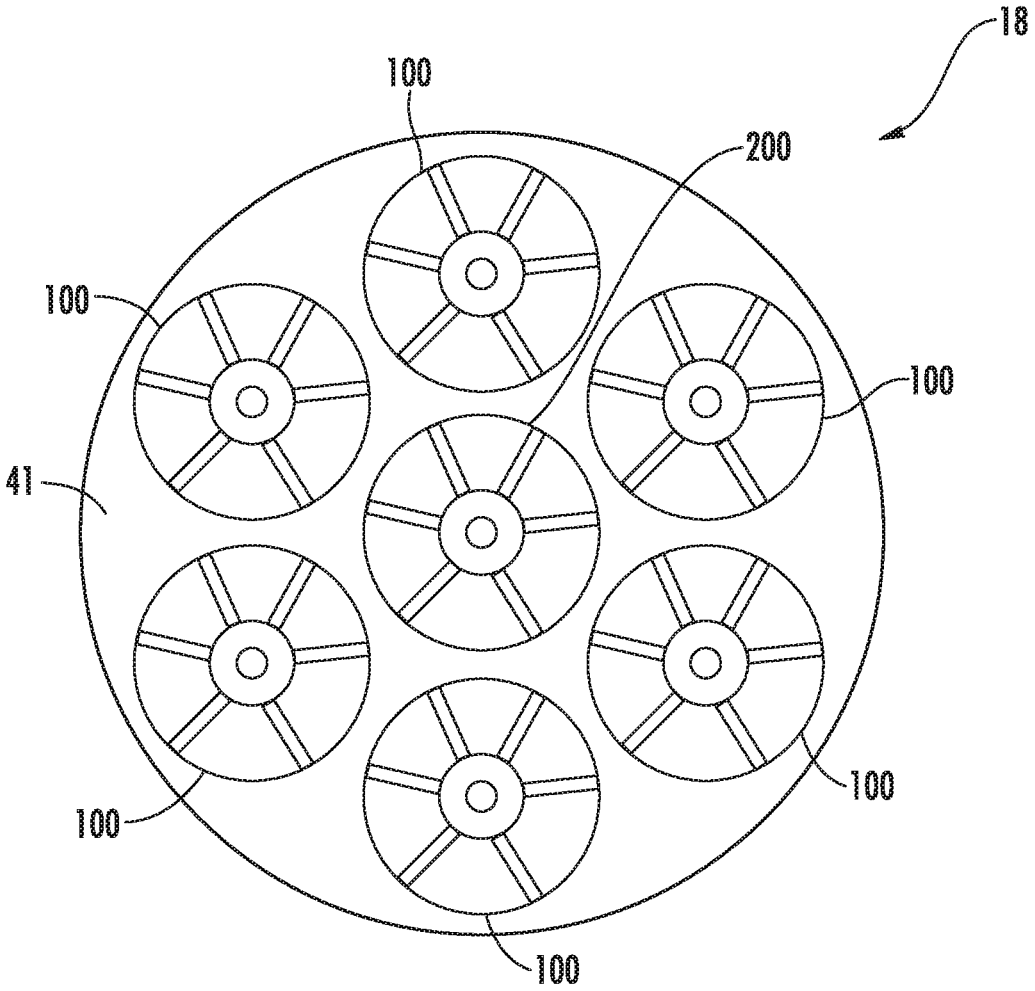
FIG. 3 is an upstream view of a portion of the combustor shown in FIG. 2, according to at least one embodiment of the present disclosure.

FIG. 3 provides an upstream view of a portion of the combustor 18 as shown in FIG. 2. In various embodiments, as shown in FIGS. 2 and 3 collectively, the combustor 18 includes multiple fuel nozzles (e.g., fuel nozzles 100) whose upstream ends are coupled to the end cover 40 and that extend toward the combustion chamber 46. The downstream ends of the fuel nozzles are aligned with respective openings (not shown) in a cap assembly 41, such that the fuel nozzles deliver fuel (or a fuel/air mixture) to the combustion chamber 46.

Various embodiments of the combustor 18 may include different numbers and arrangements of fuel nozzles, and the presently described embodiments are not limited to any particular number of fuel nozzles, unless otherwise specified in the claims. For example, in particular configurations, such as those shown in FIG. 3, the one or more fuel nozzles includes multiple dual-fuel fuel nozzles 100 annularly arranged about a center fuel nozzle 200. In other embodiments, the fuel nozzles 100 may be annularly arranged about a centerline of the end cover 40 without the use of a center fuel nozzle 200. Because the fuel nozzles 100 are radially outward of the centerline of the end cover 40 (and, in some embodiments, the center fuel nozzle 200), the fuel nozzles 100 may be referred to as "outer" fuel nozzles.

In particular embodiments, each outer fuel nozzle 100 is a pre-mix, dual-fuel type fuel nozzle. Each dual-fuel fuel nozzle 100 is configured to inject and premix a gaseous fuel and/or a liquid fuel with a flow of a portion of the compressed air 28 from the head end volume 42 (FIG. 2) upstream from the combustion zone 46. In particular embodiments, the center fuel nozzle 200 is also a pre-mix, dual-fuel (liquid fuel and gas fuel) type fuel nozzle. Other types of fuel nozzles may be used instead of the center fuel nozzle 200, as needs dictate.

Figure 4:
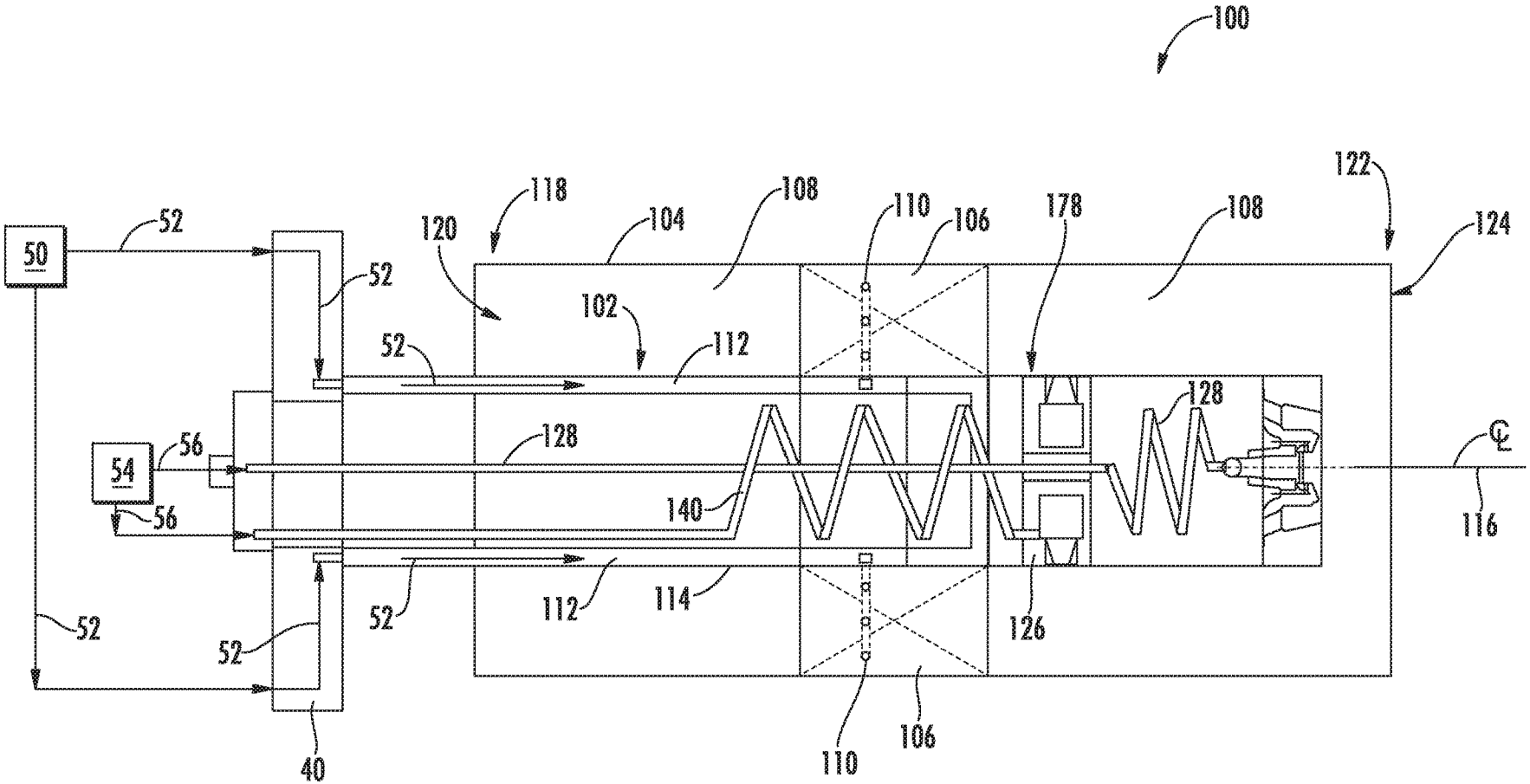
FIG. 4 is a cross-sectioned side view of an exemplary dual-fuel fuel nozzle with pre-mix and dual-fuel capabilities, according to at least one embodiment of the present disclosure.

FIG. 4 provides a cross-sectioned side view of an exemplary dual-fuel fuel nozzle 100 with pre-mix and dual-fuel capabilities, according to at least one embodiment of the present disclosure. In particular embodiments, such as those shown in FIG. 4, the dual-fuel fuel nozzle 100 includes a center body 102 having an annular or tube shape. In particular embodiments, the dual-fuel fuel nozzle 100 may include a burner tube 104 that extends circumferentially around at least a portion of the center body 102 and a plurality of turning vanes 106 that extend between the center body 102 and the burner tube 104. The turning vanes 106 are disposed within an annular or premix passage 108 that is defined radially between the center body 102 and the burner tube 104. In particular embodiments, one or more of the turning vanes 106 includes one or more fuel ports 110 that is/are in fluid communication with a gas fuel plenum 112 defined within the center body 102. The gas fuel plenum 112 is fluidly coupled to a gas fuel supply 50 (FIG. 4) to receive a gas fuel 52 therefrom.

As shown in FIG. 4, the center body 102 may be formed from one or more sleeves or tubes 114 that are coaxially aligned with a common longitudinal axis or axial centerline 116 shared by the center body 102 and the dual-fuel fuel nozzle 100. The axial centerline 116 of the center fuel nozzle 200 is coincident with an axial centerline of the end cover 40. The dual-fuel fuel nozzle 100 may be connected to an inner surface of the end cover 40 via mechanical fasteners or by other connecting means (not shown). In particular embodiments and as shown in FIG. 4, an upstream end portion 118 of the burner tube 104 may at least partially define an inlet 120 to the premix passage 108, and a downstream end portion 122 of the burner tube 104 may at least partially define an outlet 124 of the premix passage 108. In at least one embodiment, the inlet 120 is in fluid communication with the head end volume 42 (FIG. 2) of the combustor 18.

Figure 5:
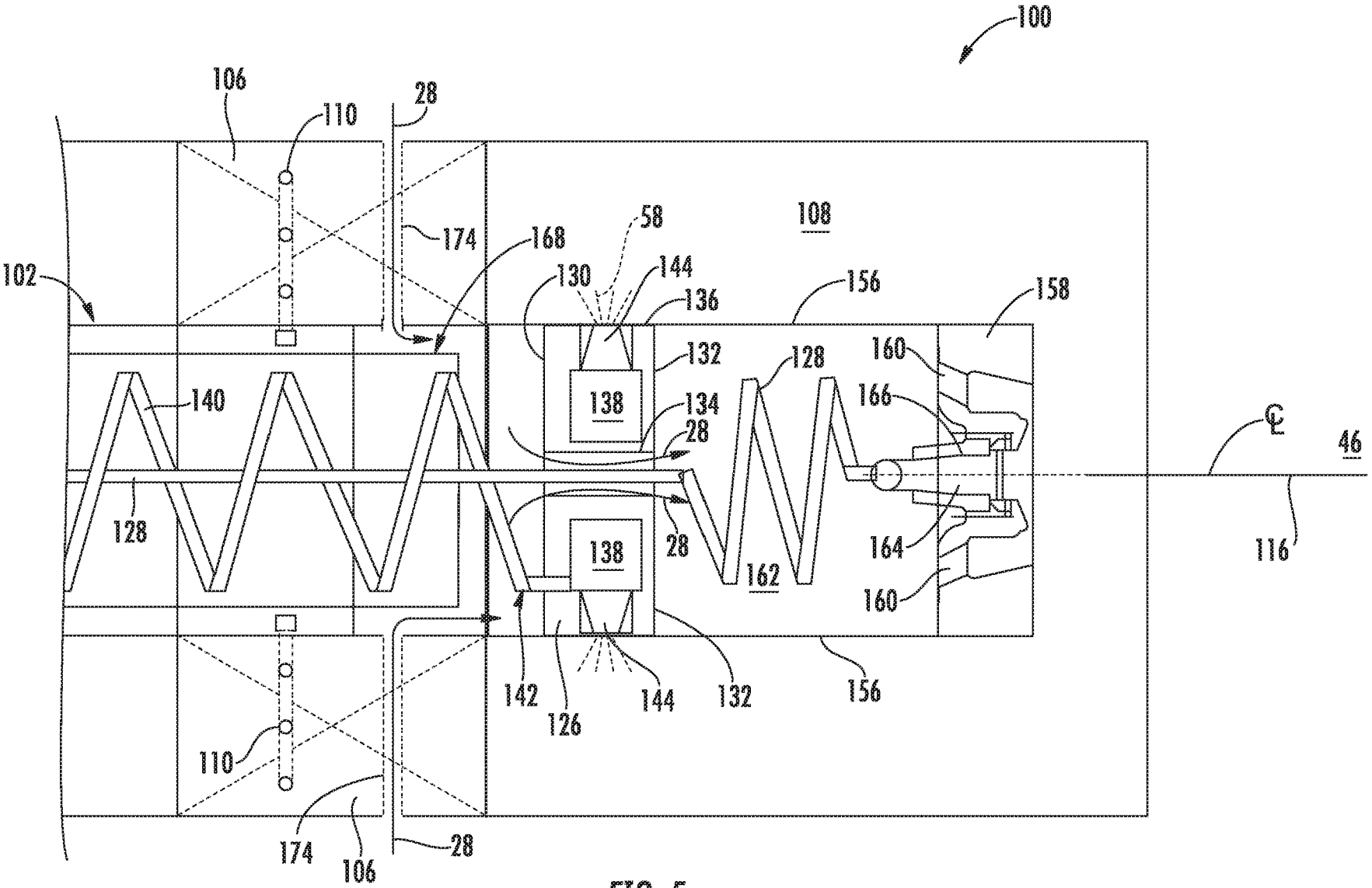
FIG. 5 is an enlarged view of a portion of the dual-fuel fuel nozzle shown in FIG. 4.

FIG. 5 provides an enlarged view of a portion of the dual-fuel fuel nozzle 100 shown in FIG. 4. In various embodiments, examples of which are shown in FIGS. 4 and 5 collectively, the dual-fuel fuel nozzle 100 includes a ring manifold 126 and an inner fuel tube 128 that extends axially and/or coaxially through the ring manifold 126 with respect to the axial centerline 116.

Figure 6:
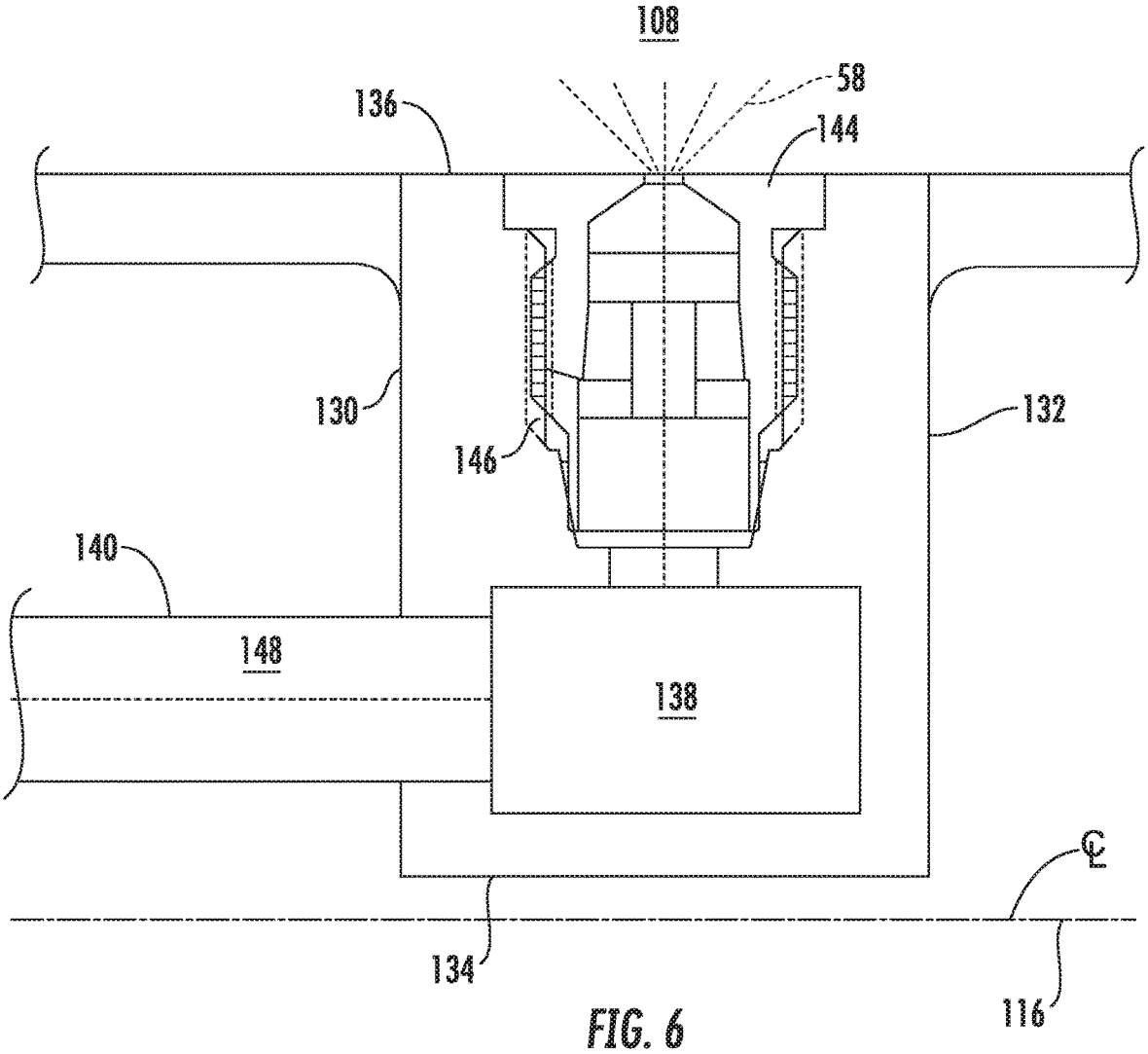
FIG. 6 is an enlarged cross-sectioned side view of a portion the dual-fuel fuel nozzle shown in FIGS. 4 and 5, according to at least one embodiment of the present disclosure.

As shown in FIGS. 5 and 6, the ring manifold 126 includes a forward side wall 130 that is axially spaced from an aft side wall 132 with respect to the axial centerline 116. The ring manifold 126 comprises an inner band 134 that is radially spaced from an outer band 136 with respect to the axial centerline 116. A liquid fuel plenum 138 is defined within the ring manifold 126 between the inner band 134, the outer band 136, the forward side wall 130, and the aft side wall 132.

In particular embodiments, as detailed in FIGS. 4 and 5 collectively, the liquid fuel plenum 138 is fluidly coupled to a liquid fuel supply 54 via a first fuel tube 140. At least a portion of the first fuel tube 140 extends helically within the center body 102 about or around the inner fuel tube 128 upstream of the forward side wall 130 of the ring manifold 126 and is disposed radially inwardly from the gas fuel plenum 112. Referring to FIG. 5, an aft end 142 of the first fuel tube 140 may be connected to the forward side wall 130 and fluidly coupled to the liquid fuel plenum 138 of the ring manifold 126.

The inner band 134 of the ring manifold 126 is detached from the inner tube 128. Rather, the outer band 136 of the ring manifold 126 is attached to the center body 102 and an outer sleeve 156, as described further herein. Thus, in particular embodiments, the inner tube 128 is thermally decoupled from the ring manifold 126, such that the inner tube 128 is unrestrained in its thermal growth or movement through the ring manifold 126.

FIG. 6 provides an enlarged cross-sectioned side view of a portion the center body 102 shown in FIGS. 4 and 5, according to at least one embodiment of the present disclosure. In particular embodiments, such as those as shown in FIGS. 5 and 6 collectively, a plurality of radially oriented fuel injectors 144 is circumferentially spaced about/within the outer band 136, each of which is in fluid communication with the liquid fuel plenum 138. Each fuel injector 144 of the plurality of fuel injectors 144 is radially oriented with respect to axial centerline 116 to inject an atomized jet of liquid fuel 56 into the premix passage 108 at a location that is downstream from the turning vanes 106 and/or the fuel ports 110. The atomized jet of liquid fuel is directed in a generally radial direction from the fuel injectors 144, relative to the axial centerline 116.

In particular embodiments, as detailed in FIG. 6, one or more of the radially oriented fuel injectors 144 may be screwed into, threaded into, or otherwise removably attached within a corresponding opening 146 of the ring manifold 126 to facilitate maintenance (e.g., cleaning) or replacement, as needed. As shown in FIG. 6, the first fuel tube 140 provides or defines a first fluid passage 148 for passing the liquid fuel 56 from the liquid fuel supply 54 to the liquid fuel plenum 138.

Figure 7:
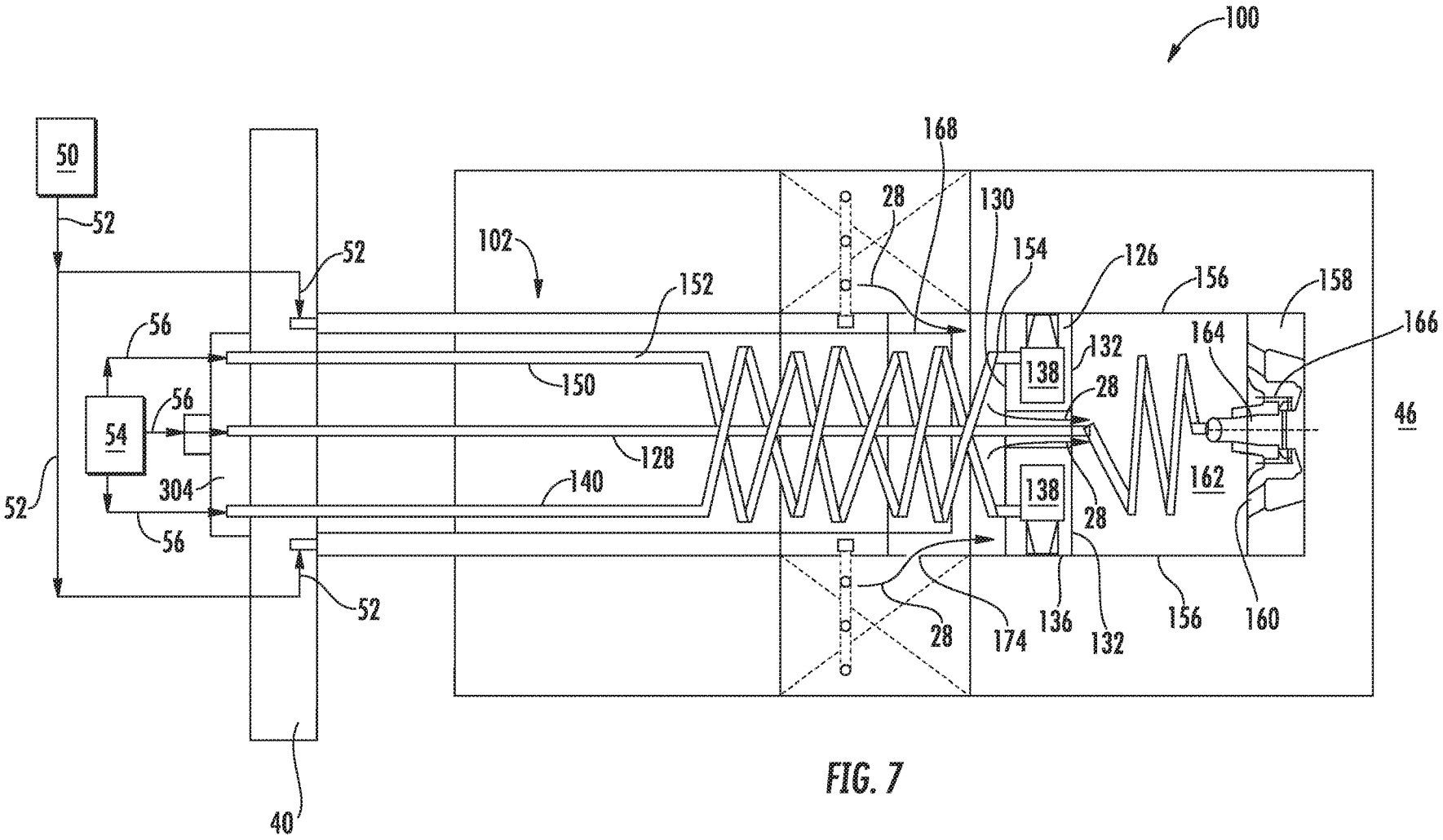
FIG. 7 is a cross-sectioned side view of the dual-fuel fuel nozzle shown in FIGS. 4, 5, and 6, according to at least one embodiment of the present disclosure.

FIG. 7 provides a cross-sectioned side view of the exemplary dual-fuel fuel nozzle 100 shown in FIGS. 4 through 6, according to at least one embodiment of the present disclosure. In particular embodiments, such as those shown in FIG. 7, the dual-fuel fuel nozzle 100 includes a second fuel tube 150 that defines a second fluid passage 152 for passing the liquid fuel 56 from the liquid fuel supply 54 to the liquid fuel plenum 138. At least a portion of the second fuel tube 150 extends helically within the center body 102 about and/or around the inner fuel tube 128 upstream of the forward side wall 130 of the ring manifold 126 and is disposed radially inwardly from the gas fuel plenum 112. An aft end 154 of the second fuel tube 150 may be connected to the forward side wall 130 and fluidly coupled to the liquid fuel plenum 138 of the ring manifold 126. During operation, the inner fuel tube 128 is unrestrained in its thermal growth or expansion through the ring manifold 126 and with respect to the first fuel tube 140 and the second fuel tube 150.

The first fuel tube 140 and the second fuel tube 150 are coiled to act like a spring. In the illustrated embodiment, the tubes 140, 150 are coiled in the same direction (e.g., clockwise or counter-clockwise). The coiling of the first and second fuel tubes 140, 150 accommodates thermal differences between the liquid fuel supply 54, the compressed air 28 from the head end volume 42, and the gas supply system 50. The first and second fuel tubes 140, 150 do not intersect, but rather are radially outward of, the axial centerline 116 of the dual-fuel fuel nozzle 100. In particular embodiments, the coils of the first and second fuel tubes 140, 150 are wound together and have identical spacing and number of turns.

In particular embodiments, as shown in FIGS. 5 and 7, the center body 102 further comprises an outer sleeve 156. The outer sleeve 156, which may be connected to the outer band 136, extends aft of the aft side wall 132 of the ring manifold 126. In particular embodiments, as shown in FIGS. 5 and 7, a nozzle body or disk 158 is connected to the outer sleeve 156 downstream from the aft side wall 132 of the ring manifold 126. The nozzle body 158 extends radially and circumferentially within the outer sleeve 156 with respect to axial centerline 116. The nozzle body 158 defines a plurality of apertures 160. The aft side wall 132 of the ring manifold 126, the outer sleeve 156, and the nozzle body 158 collectively define a fluid chamber 162 within the outer sleeve 156. The plurality of apertures 160 is in fluid communication with the fluid chamber 162. The fluid chamber 162 may be in fluid communication with a compressed air or diluent supply such as the head end volume 42 and/or the high pressure plenum 38 (FIG. 2).

In particular embodiments, as shown in FIGS. 5 and 7, the nozzle body 158 includes a fuel injector 164. The fuel injector 164 is axially oriented with respect to axial centerline 116 and is in fluid communication with the liquid fuel supply 54 via the inner fuel tube 128. In operation, the fuel injector 164 injects atomized liquid fuel 56 into the combustion zone 46 at a location that is downstream from the turning vanes 106 and downstream from the plurality of radially oriented fuel injectors 144. In particular embodiments, the fuel injector 164 may be screwed into, threaded into, or otherwise removably attached within a corresponding opening 166 of the nozzle body 158 to facilitate maintenance (e.g., cleaning) or replacement, as needed.

In various embodiments, as shown in FIGS. 5 and 7, a portion of the inner fuel tube 128 that is disposed within the fluid chamber 162 extends helically about the axial centerline 116 of the dual-fuel fuel nozzle 100 between the aft side wall 132 of the ring manifold 126 and the nozzle body 158. In operation, the helical portion of the inner fuel tube acts as a spring to allow the inner fuel tube to grow and contract due to thermal differences between the liquid fuel supply 54, the compressed air 28 from the head end volume 42 and the gas supply system 50.

Figure 8:
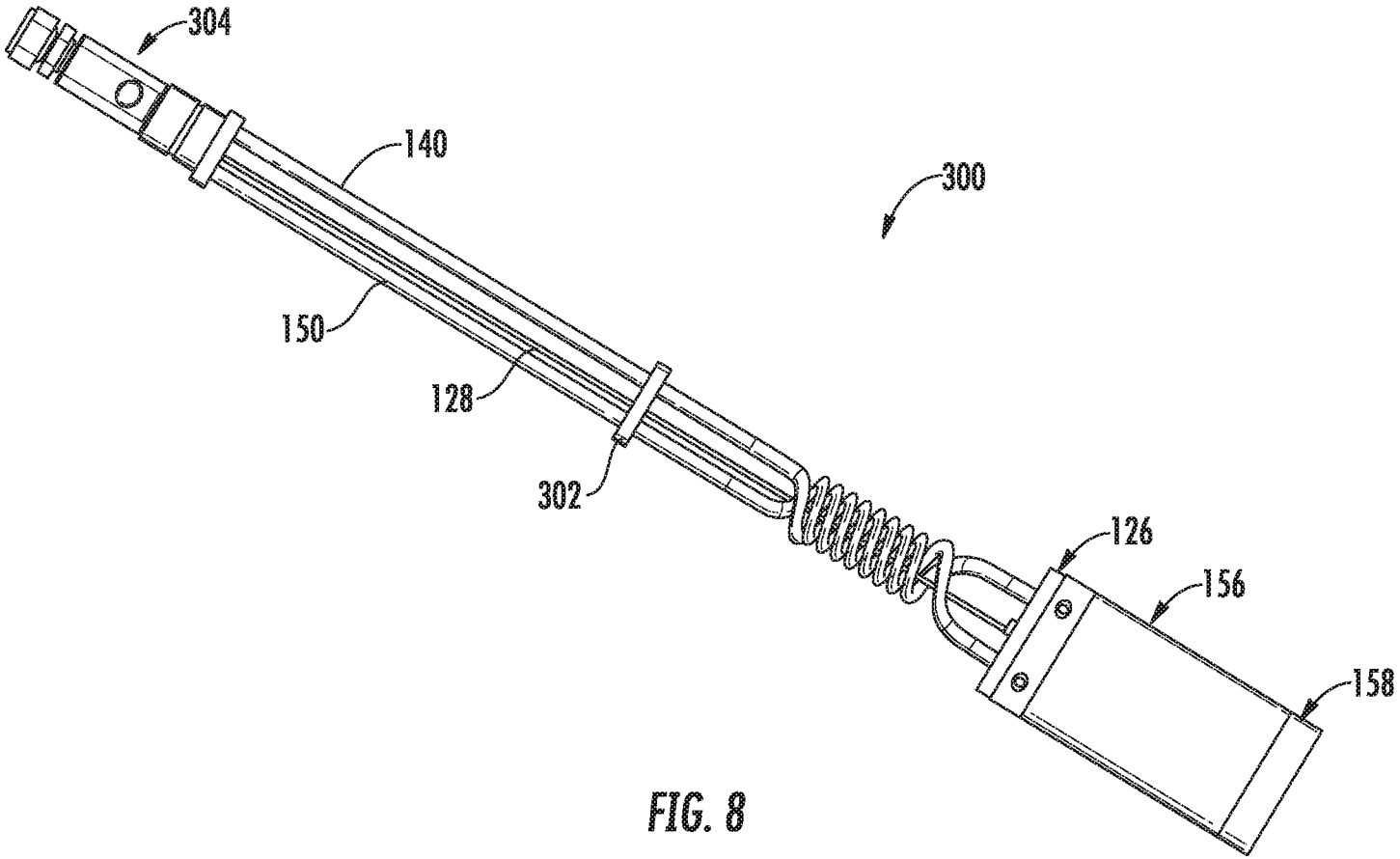
FIG. 8 is a side view of a nozzle assembly of the dual-fuel fuel nozzle shown in FIG. 7, according to at least one embodiment of the present disclosure.

FIG. 8 provides a side view of a nozzle assembly of the dual-fuel fuel nozzle 100 shown in FIG. 7, according to at least one embodiment. As shown in FIG. 8, the nozzle body 158, the outer sleeve 156, the ring manifold 126, the inner fuel tube 128, the first fuel tube 140, and the second fuel tube 150 may be provided as a nozzle assembly 300. The nozzle assembly 300 may further include a baffle or tube support member 302 that provides radial support to one or more of the inner fuel tube 128, the first fuel tube 140 and the second fuel tube 150. The nozzle assembly 300 may also include a fuel manifold 304 that fluidly couples the inner fuel tube 128, the first fuel tube 140 and the second fuel tube 150 to the liquid fuel supply 54. As shown in FIG. 7, the fuel manifold 304 may be connected to and/or extend axially through the end cover 40. In particular embodiments, neither the first fuel tube 140 nor the second fuel tube 150 intersect an axial centerline 306 of the fuel nozzle assembly 300.

In particular embodiments, as shown in FIG. 5, the dual-fuel fuel nozzle 100 may include an air shield or deflector 168 that extends circumferentially around the inner fuel tube 128 and the first fuel tube 140 or, as shown in FIG. 7, extends circumferentially around the inner fuel tube 128, the first fuel tube 140, and the second fuel tube 150. As shown in FIGS. 5 and 7 collectively, the air shield 168 is positioned upstream from the forward side wall 130 of the ring manifold 226, and the air shield 168 is positioned upstream from the fluid chamber 162.

Figure 9:
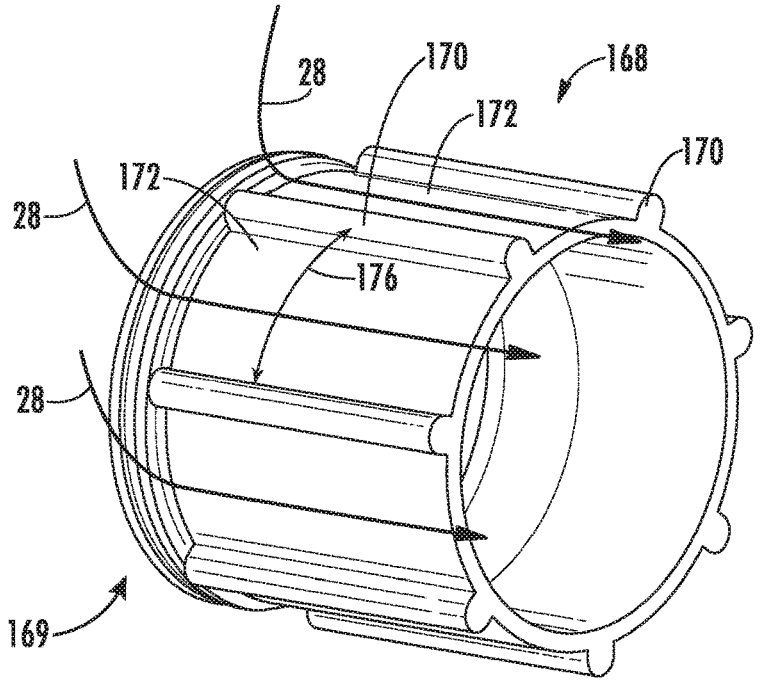
FIG. 9 is a perspective view of an exemplary air shield, according to at least one embodiment of the present disclosure.
Figure 10:
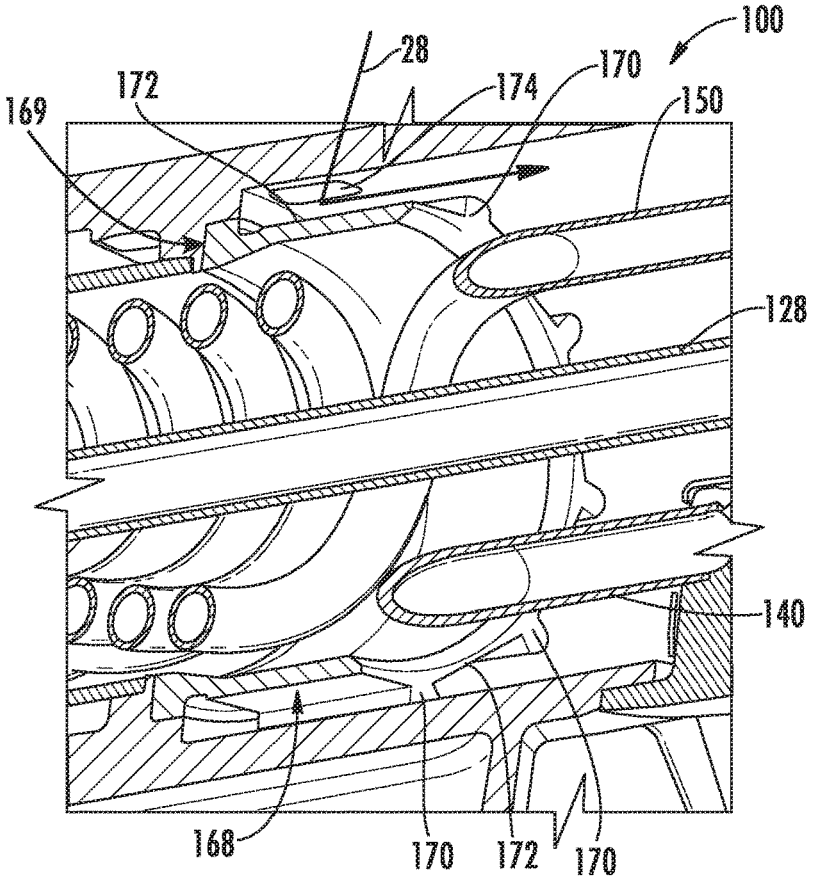
FIG. 10 is a cross-sectioned perspective view of a portion of the dual-fuel fuel nozzle shown in FIG. 7 including the air shield shown in FIG. 9, according to at least one embodiment of the present disclosure.

FIG. 9 provides a perspective view of an exemplary air shield 168, according to at least one embodiment of the present disclosure. FIG. 10 provides a cross-sectioned perspective view of a portion of the dual-fuel fuel nozzle 100 with the air shield 168 installed. As shown in FIGS. 9 and 10 collectively, the air shield 168 may include a forward end 169 and a plurality of protrusions or ribs 170 that extend radially outwardly from an outer surface 172 of the air shield 168.

In operation, as illustrated in FIGS. 9 and 10 collectively, compressed air 28 from the head end chamber 42 enters the center body 102 via a plurality of apertures 174 defined by the turning vanes 106 (FIG. 5). As the compressed air 28 strikes the outer surface 172 of the air shield 168, it stagnates. The ribs 170 create axial flow channels 176 that straighten the high velocity, high temperature, swirling compressed air 28 and that redirect the air 28 in an axial direction. The straightening of the streams of compressed air 28 helps to ensure that the compressed air 28 does not impinge directly on the inner fuel tube 128, the first fuel tube 140, and/or the second fuel tube 150. Additionally, straightening the streams of compressed air 28 lowers the peak velocity of the compressed air 28, thus reducing the heat transfer from the compressed air 28 into the inner fuel tube 128, the first fuel tube 140, and/or the second fuel tube 150 that are carrying the liquid fuel 56. This deflection of the compressed air 28 keeps the internal surfaces, which may be wetted with liquid fuel, from experiencing temperatures that are sufficiently high to result in thermal breakdown of the fuel and subsequent coke formation, particularly when the liquid fuel 56 is not moving therethrough at a sufficient velocity. The compressed air 28 may then flow through and/or around various openings defined by and/or around the ring manifold 126 and into the fluid chamber 162, thereby providing cooling and/or purge air to the nozzle body 158.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dual-fuel fuel nozzle, comprising:

a center body having a tube shape;

a gas fuel plenum defined within the center body;

a plurality of turning vanes extending radially outward from the center body, each turning vane including at least one fuel port in fluid communication with the gas fuel plenum, wherein a plurality of apertures extends through the plurality of turning vanes and the center body;

a ring manifold disposed within the center body downstream of the plurality of turning vanes, the ring manifold extending radially between an inner band and an outer band and axially between a forward side wall and an aft side wall;

a nozzle body connected to an aft end of an outer sleeve, wherein the ring manifold, the outer sleeve and the nozzle body define a fluid chamber;

an inner fuel tube extending axially within the center body, through the ring manifold to the nozzle body, the ring manifold defining a radial gap between the ring manifold and the inner fuel tube, the radial gap extending axially from the forward side wall of the ring manifold to the aft side wall of the ring manifold;

a first fuel tube extending helically around a centerline of the center body, the first fuel tube supplying liquid fuel to at least one radially oriented fuel injector in the ring manifold; and an air shield disposed within the center body and extending circumferentially around the first fuel tube such that a forward end of the air shield is positioned downstream of the at least one fuel port and upstream the plurality of apertures relative to a direction of flow through the dual-fuel nozzle, the air shield being in fluid communication with the plurality of apertures, the air shield positioned within the outer band such that the air shield directs air through the radial gap to the fluid chamber.

2. The dual-fuel fuel nozzle as in claim 1, wherein the air shield includes a plurality of ribs extending radially outwardly from an outer surface of the air shield.

3. The dual-fuel fuel nozzle as in claim 2, wherein circumferentially adjacent ribs of the plurality of ribs form a respective axial flow channel circumferentially therebetween.

4. The dual-fuel fuel nozzle as in claim 1, wherein the air shield is positioned upstream from the ring manifold.

5. The dual-fuel fuel nozzle as in claim 1, further comprising a second fuel tube extending helically around the centerline of the center body, the second fuel tube being fluidly coupled to a fuel plenum of the ring manifold, wherein the air shield extends circumferentially around the first fuel tube and the second fuel tube.

6. The dual-fuel fuel nozzle as in claim 5, wherein the first fuel tube and the second fuel tube are disposed radially inwardly from the gas fuel plenum.

7. The dual-fuel fuel nozzle as in claim 5, wherein the first fuel tube and the second fuel tube are radially outward of the centerline of the center body.

8. The dual-fuel fuel nozzle as in claim 5, wherein coils of the first fuel tube and the second fuel tube are wound together with identical spacing and numbers of turns.

9. The dual-fuel fuel nozzle as in claim 1, wherein the inner fuel tube is in fluid communication with an axially oriented fuel injector of the nozzle body, wherein a portion of the inner fuel tube extends helically about an axial centerline of the center body between the aft side wall of the ring manifold and the nozzle body.

10. The dual-fuel fuel nozzle as in claim 9, wherein the inner fuel tube is axially unrestrained by the ring manifold.

11. The dual-fuel fuel nozzle as in claim 1, further comprising a burner tube circumferentially surrounding a portion of the center body, wherein the burner tube and the center body define a premix passage therebetween, wherein the plurality of turning vanes extends radially between the center body and the outer sleeve within the premix passage.

12. The dual-fuel fuel nozzle as in claim 1, wherein the at least one radially oriented fuel injector comprises a plurality of radially oriented fuel injectors, the plurality of radially oriented fuel injectors are disposed downstream from the plurality of turning vanes.

13. A combustor, comprising:

an end cover;

a plurality of dual-fuel fuel nozzles connected to the end cover and annularly arranged around a centerline of the end cover, each dual-fuel fuel nozzle comprising:

a center body having a tube shape;

a gas fuel plenum defined within the center body;

a plurality of turning vanes extending radially outward from the center body, each turning vane including at least one fuel port in fluid communication with the gas fuel plenum, wherein a plurality of apertures extends through the plurality of turning vanes and the center body;

a ring manifold disposed within the center body downstream of the plurality of turning vanes, the ring manifold extending radially between an inner band and an outer band and axially between a forward side wall and an aft side wall;

a nozzle body connected to an aft end of an outer sleeve, wherein the ring manifold, the outer sleeve and the nozzle body define a fluid chamber;

an inner fuel tube extending axially within the center body, through the ring manifold to the nozzle body, the ring manifold defining a radial gap between the ring manifold and the inner fuel tube, the radial gap extending axially from the forward side wall of the ring manifold to the aft side wall of the ring manifold;

a first fuel tube extending helically around a centerline of the center body, the first fuel tube supplying liquid fuel to at least one radially oriented fuel injector in the ring manifold; and an air shield disposed within the center body and extending circumferentially around the first fuel tube such that a forward end of the air shield is positioned downstream of the at least one fuel port and upstream the plurality of apertures relative to a direction of flow through the dual-fuel nozzle, the air shield being in fluid communication with the plurality of apertures, the air shield positioned within the outer band such that the air shield directs air through the radial gap to the fluid chamber.

14. The combustor as in claim 13, wherein the air shield is positioned upstream from the ring manifold.

15. The combustor as in claim 13, wherein the air shield includes a plurality of protrusions or ribs extending radially outward from an outer surface of the air shield.

16. The combustor as in claim 15, wherein circumferentially adjacent ribs of the plurality of ribs form a respective axial flow channel circumferentially therebetween.

17. The combustor as in claim 13, wherein the dual-fuel fuel nozzle further comprises a second fuel tube extending helically around the centerline of the center body, the second fuel tube being fluidly coupled to a fuel plenum of the ring manifold, wherein the air shield extends circumferentially around the first fuel tube and the second fuel tube.

18. The combustor as in claim 17, wherein the first fuel tube and the second fuel tube are disposed radially inwardly from the gas fuel plenum.

19. The combustor as in claim 17, wherein the first fuel tube and the second fuel tube are radially outward of the centerline of the center body.

* * * * *